US008263932B2

(12) United States Patent
Yamaguchi

(10) Patent No.: US 8,263,932 B2
(45) Date of Patent: Sep. 11, 2012

(54) MASS-ANALYZING METHOD

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 11 days.

(21) Appl. No.: 13/125,545

(22) PCT Filed: Oct. 30, 2008

(86) PCT No.: PCT/JP2008/003106
§ 371 (c)(1),
(2), (4) Date: Apr. 21, 2011

(87) PCT Pub. No.: WO2010/049973
PCT Pub. Date: May 6, 2010

(65) Prior Publication Data

US 2011/0192971 A1 Aug. 11, 2011

(51) Int. Cl.
*H01J 49/40* (2006.01)

(52) U.S. Cl. ..... 250/287; 250/291

(58) Field of Classification Search ..... 250/287, 250/290, 291
See application file for complete search history.

(56) References Cited

U.S. PATENT DOCUMENTS

| | | | | |
|---|---|---|---|---|
| 7,211,792 | B2 * | 5/2007 | Yamaguchi et al. | 250/287 |
| 7,999,223 | B2 * | 8/2011 | Makarov et al. | 250/290 |
| 2005/0151076 | A1 | 7/2005 | Yamaguchi et al. | 250/291 |

FOREIGN PATENT DOCUMENTS

| | | |
|---|---|---|
| JP | 2005-203129 | 7/2005 |
| JP | 2007-333528 | 12/2007 |
| JP | 04-033133 | 1/2008 |

OTHER PUBLICATIONS

Japanese language international preliminary report on patentability dated May 3, 2011 and its English language translation for corresponding PCT application PCT/JP2008/003106.

* cited by examiner

*Primary Examiner* — Kiet T Nguyen
(74) *Attorney, Agent, or Firm* — DLA Piper LLP (US)

(57) ABSTRACT

A variety of ions generated in an ion source are made to fly while bypassing a loop orbit and mass analyzed to create a mass spectrum. Among the peaks appearing on the mass spectrum, peaks complying with predetermined conditions are extracted to determine a plurality of mass ranges to be measured (S1 through S3). Next, the ion selection conditions for the timing when ions should be injected into the loop orbit and on the loop orbit are determined for each mass range. In addition, deviation conditions under which selected ions will not be mixed are determined (S4 and S5). When the second measurement is performed for the same sample, ions are put into the loop orbit and unnecessary ions are removed from the loop orbit in accordance with the ion selection conditions (S6 and S7). Thus, only the ions to be measured are left on the loop orbit with a high mass resolving power. Then, these ions are sequentially deviated from the loop orbit in accordance with the ion deviation conditions, dissociated, and then mass analyzed (S8). In this manner, MS/MS analyses are performed for each of the plurality of ions to be measured to create an MS/MS spectrum (S10).

8 Claims, 3 Drawing Sheets

MASS-ANALYZING METHOD

CROSS-REFERENCE TO THE RELATED APPLICATIONS

This application is a national stage of international application No. PCT/P2008/003106, filed on Oct. 30, 2008, the entire contents of which are incorporated herein by reference.

TECHNICAL FIELD

The present invention relates to a mass-analyzing method. More specifically, it relates to a mass-analyzing method for performing an MS/MS analysis by using a mass spectrometer having a multi-turn orbit in which ions are made to repeatedly fly along a closed orbit.

BACKGROUND ART

An ion trap time-of-flight mass spectrometer (IT-TOFMS) has been known as a type of mass spectrometer. In an IT-TOFMS, ions generated in an ion source are temporarily stored in an ion trap, and an ion selection is performed so that only ions having a specific mass (to be exact, a mass to charge ratio m/z) are left in the ion trap. After that, a collision-induced dissociation gas is introduced into the ion trap and the remaining ions are dissociated as precursor ions. A variety of product ions generated by the dissociation are collectively ejected from the ion trap to be introduced into the TOFMS, where they are mass-analyzed. That is, by performing an MS/MS analysis, it is possible to obtain mass spectra of a variety of product ions generated by the dissociation of precursor ions originating from the sample.

As an ion trap, a three-dimensional quadrupole ion trap, a linear ion trap, and other types of ion traps are known. In general, however, the mass selectivity (mass resolving power) of ions in such an ion trap is not always high. Hence, if there is an ion or ions which have a mass that is very close to that of the target precursor ion, it is difficult to exclude such ions from the process of dissociateing the target precursor ion.

In recent years, the importance of accurately identifying a macromolecule such as protein has been increasing. However, with an MS/MS analysis in which an ion trap and a TOFMS are combined as previously described, it is difficult to obtain accurate structure information on a target component. Given this factor, in order to particularly enhance the mass selectivity of a precursor ion, a MALDI-TOF/TOF mass spectrometer has been recently known in which various kinds of TOF mass analyzers, such as a liner TOF, a reflection TOF, and a helical orbit TOF, are combined in two stages (refer to Patent Document 1 and other documents). However, with such a conventional TOF/TOF mass spectrometer, for one ejection of ions from an ion source, only one kind of ions included in the ejected ions can be MS/MS analyzed. Therefore, when it is required to obtain the structure information on a plurality of components contained in the sample, an ionization process and an MS/MS analysis must be repeated, which makes it difficult to enhance the throughput of the analysis.

[Patent Document 1] JP-A 2007-333528

[Patent Document 2] JP-B 4033133

DISCLOSURE OF THE INVENTION

Problem to be Solved by the Invention

The applicant of the present patent application has proposed a new mass spectrometer described in Patent Document 2, which uses a multi-turn orbit. In this mass spectrometer, a multi-turn (MT)-TOF mass analyzer having a multi-turn orbit in place of the aforementioned ion trap is used. A variety of ions generated in the ion source are made to repeatedly fly along the multi-turn orbit to separate them in accordance with their mass. During their flight, ions other than the target ions are deviated from the loop orbit and excluded. In this manner, the target ions remaining on the loop orbit are finally deviated from the loop orbit and then dissociated. By mass-analyzing the product ions generated by the dissociation, an MS/MS analysis can be performed.

In this mass spectrometer, any unnecessary ions can be excluded from the ions flying along the loop orbit, and not only one kind but a plurality of kinds of ions can be finally left on the loop orbit. In the case where only one kind of ions is left on the loop orbit and then the ions are deviated from the loop orbit to be dissociated and their product ions are mass-analyzed, deviating ions from the loop orbit is easy. This is because, if only one kind of ions is left on the loop orbit, there is no possibility that plural kinds of ions are mixed due to the difference of their masses, and therefore plural kinds of ions will not be simultaneously deviated from the loop orbit. On the other hand, in the case where plural kinds of ions are left on the loop orbit, the plural kinds of ions might be mixed on the loop orbit. Therefore, if each kind of these ions must be separately MS/MS analyzed, it is necessary to devise a method to avoid such a mixture which might occur when ions are deviated from the loop orbit to be dissociated and mass-analyzed.

The present invention has been developed in view of the aforementioned problem, and the main objective thereof is to provide a mass-analyzing method capable of efficiently performing an MS/MS analysis of a plurality of components by selecting and capturing plural kinds of target ions with a high mass resolving power and then mass analyzing product ions generated by dissociating each of the target ions.

Means for Solving the Problem

To solve the aforementioned problem, the present invention provides a mass-analyzing method using a multi-turn time-of-flight mass spectrometer having:

an ion source;

a loop orbit along which a variety of ions departing from the ion source are made to fly once or repeatedly plural times;

an ion selector for selecting ions from the ions flying along the loop orbit by allowing a passage of ions along the loop orbit only within a predetermined time range;

a dissociation means for dissociating ions deviated from the loop orbit; and a mass analyzing means for mass analyzing product ions generated by the dissociation, the mass-analyzing method including:

a) a setting step for setting a plurality of masses of ions to be measured;

b) an ion selection step for obtaining the predetermined time range for each of the plurality of masses set in the setting step and for operating the ion selector so as to allow the passage of ions only within the predetermined time range and thereby select, on the loop orbit, each of the ions having the set plurality of masses;

c) a deviation timing determination step for obtaining deviation timings at which different kinds of ions are not mixed when the ions having the set plurality of masses are deviated from the loop orbit, time intervals of the deviation timings being determined so that a mixture of product ions will not occur while the deviated ions are dissociated and mass analyzed; and d) an analysis step for sequentially deviating ions having each of the plurality of masses left on the loop orbit in accordance with the determined deviation timings, for dissociating the deviated ions by the dissociation means to generate product ions, and for analyzing the product ions by the mass analyzing means.

The "loop orbit" used herein includes not only a closed orbit such as a circular orbit, elliptical orbit or "8" figured orbit, in which ions are made to fly along the same orbit, but a linear or curved orbit along which ions are made to reciprocate. Further, it includes a helical orbit in which ions are made to fly along almost the same but gradually-shifting orbit.

The ion source may be an ion generator capable of ionizing a variety of components in a sample, or may be a means for temporarily storing ions generated in another location and giving an acceleration energy to the ions to collectively eject them.

The ion selector may double as electrodes or the like for forming an electric field in which ions arriving from the ion source are put into the loop orbit or ions flying along the loop orbit are made to deviate from the orbit and fly toward the dissociation means. However, the ion selector may be separately provided. Alternatively, the ion selector may double as electrodes or the like for forming an electric field in which ions are made to fly along the loop orbit. That is, the ion selector has only to be able to form an electric field which affects the ions flying on the loop orbit.

The dissociation means may be realized by any device that can accelerate the dissociation of ions. For example, it may be a device for making ions collide with a collision induced dissociation gas, or delivering an excitation line such as a laser light to the ions.

The mass analyzing mans includes a mass separator and an ion detector. The method of mass separation in the mass separator is not particularly limited.

In the multi-turn time-of-flight mass spectrometer used for the mass-analyzing method according to the present invention, the flight distance of ions becomes longer as the number of their turns along the loop orbit is increased. Therefore, even in the case where ions have a slight mass difference, they can be sufficiently separated apart on the loop orbit by increasing the number of turns. The ion selector, which is located at an appropriately selected position on the loop orbit, allows the passage of ions that will pass that position in a specific time range or ranges while dispersing the other ions that will pass that position outside the time range or ranges. Thus, only the target ions can be selected with a high mass resolving power and left on the loop orbit.

Hence, in the mass-analyzing method according to the present invention, when a plurality of masses of ions to be measured are set, the aforementioned specific time ranges is computed for each of these masses. The appropriate time range for selecting ions having a specified mass on the loop orbit can be obtained from the values of the circumferential length of the loop orbit, the acceleration energy given to the ions when they are ejected from the ion source, the position of the ion selector, and other factors. If the kind of ions generated in the ion source can be known to some extent by an preliminary measurement or other method, the time range or ranges can be determined more appropriately by using this information. After an ion selection is performed based on the time range or ranges obtained in this manner, only the selected ions remain on the loop orbit. That is, the state in which only the ions selected in accordance with the mass are stored is achieved.

In the deviation timing determination step, deviation timings are obtained at which different kinds of ions are not mixed when the ions having the set plurality of masses are deviated from the loop orbit, time intervals of the deviation timings being determined so that a mixture of product ions will not occur while the deviated ions are dissociated and mass analyzed. The latter conditions are particularly important in the case where the mass analyzing means uses a time-of-flight mass analyzer. By obtaining an appropriate deviation timing for each of the ions (i.e. masses) to be measured and then deviating them from the loop orbit in accordance with the timings to introduce them into the dissociation means, it is possible to sequentially perform an MS/MS analysis of these plural kinds of ions.

In the mass-analyzing method according to the present invention, there are some possible methods for setting the masses of plural ions to be measured. In one embodiment, the kinds (or masses) of ions contained in a target sample are roughly grasped by an preliminary measurement, and the ions to be measured are automatically extracted in accordance with previously determined criteria.

That is, as one aspect of the present invention, in a first measurement of a target sample, the variety of ions departing from the ion source may be made to fly while bypassing the loop orbit or to fly along the loop orbit until they undergo a number of turns which ensures that an overtaking of the ions will not occur on the loop orbit, and then they are mass analyzed by the mass analyzing means to create a time-of-flight spectrum or a mass spectrum;

in the setting step, the plurality of masses to be measured may be set by selecting a peak or peaks complying with predetermined conditions among peaks appearing on the time-of-flight spectrum or the mass spectrum; and in a second or later measurement of the target sample, the processes of the ion selection step, the deviation timing determination step, and the analysis step may be performed.

In the case where it is necessary to examine the structure of a known specific molecule, in the setting step, a plurality of masses of ions in different charge states and originating from substantially the same molecule may be set.

In the case where the ions to be measured are specified beforehand, or where the molecules contained in the sample are assumable, in the setting step, the plurality of masses may be set based on a list of ions which is prepared in advance by an analysis operator or other persons.

Depending on the set combination of masses of plural ions or other conditions, it is impossible to set an appropriate deviation timing for each ion within the range of the determined time conditions. Given this factor, in the mass-analyzing method according to the present invention, in the case where a mass analysis of ions having all the masses set in the setting step cannot be performed in one measurement under predetermined time conditions, it is preferable that all the set masses are divided into a plurality of groups to perform the plurality of measurements. Dividing all the set masses into a plurality of groups can be achieved by using the ion selector.

EFFECTS OF THE INVENTION

With the mass-analyzing method according to the present invention, by appropriately using the ion selection with a high mass resolving power which is accomplished by making ions repeatedly fly along the loop orbit multiple times, a plurality of ions to be measured can be selected and an MS/MS analysis of each ion can be performed. Therefore, MS/MS spectra of a plurality of target ions can be efficiently obtained with a high mass resolution, which enables an efficient and accurate structure analysis of the molecules and atoms of a variety of components contained in a target sample.

EXPLANATION OF NUMERALS

1 . . . Ion Source
2 . . . Deflection Electrode
3 . . . Ion Selection Flight Space
E1 through E6 . . . Sector-Shaped Electric Field
31 through 36 . . . Troidal Sector-Shaped Electrode
4 . . . Dissociation Area
5 . . . Laser Light Source
6 . . . Mass Analysis Flight Space
7 . . . Reflector
8 . . . Ion Detector
10 . . . Data Processor
11 . . . Controller
12 . . . Input Unit
13 . . . Display Unit
14 . . . Loop Flight Voltage Generator
15 . . . Deflection Voltage Generator
16 . . . Reflector Voltage Generator
P . . . Loop Orbit

BEST MODE FOR CARRYING OUT THE INVENTION

First, an embodiment of a mass spectrometer used for the mass-analyzing method according to the present invention will be described with reference to FIG. 1, which is an overall configuration diagram of the mass spectrometer of the present embodiment.

Figure 1:
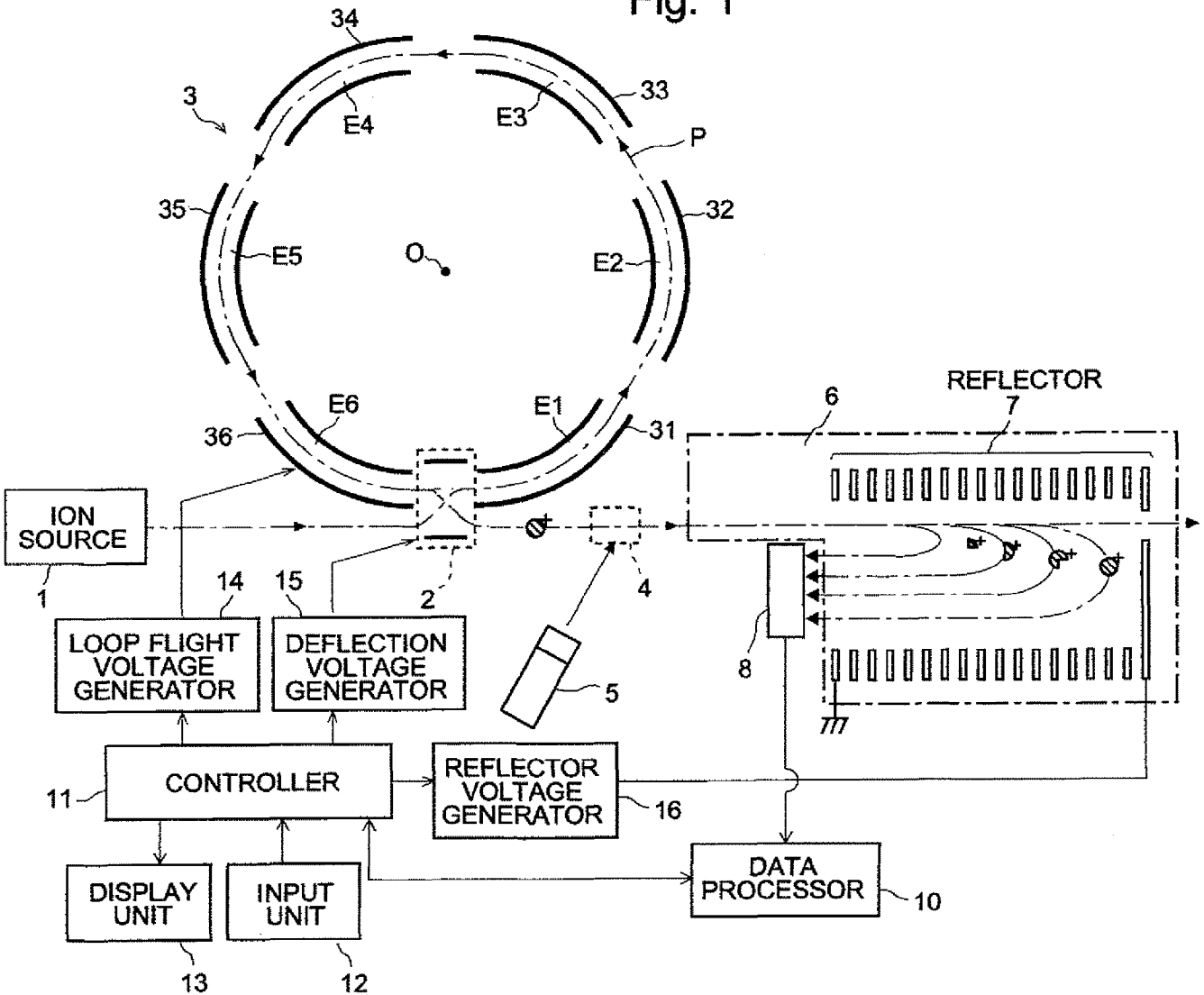
FIG. 1 is a schematic configuration diagram of an embodiment of a mass spectrometer for carrying out the mass-analyzing method according to the present invention.

In FIG. 1, an ion source 1, an ion selection flight space 3 in which a loop orbit P is formed, a mass analysis flight space 6 in which a reflector 7 is provided, an ion detector 8, and other components are provided inside a vacuum chamber which is not shown.

The ion source 1 ionizes component molecules contained in the target sample, and the ionizing method is not particularly limited. For example, if this mass spectrometer is used as a detector for a gas chromatograph (GC), an electron ionization (EI) method, a chemical ionization (CI) method, or another method is used. If this mass spectrometer is used as a detector for a liquid chromatograph (LC), an atmospheric pressure chemical ionization (APCI) method, an electrospray ionization (ESI) method, or another method is used. If the molecule to be analyzed is a macromoleculer compound such as protein, a laser ionization method, such as a matrix assisted laser desorption ionization (MALDI) method, is effective.

In the ion selection flight space 3, a plurality (six, in this example) of troidal sector-shaped electrodes 31 through 36 are arranged to make ions fly along a substantially circular loop orbit P. Each of the six identically-shaped troidal sector-shaped electrodes 31 through 36 has a shape that is obtained by cutting a concentric double cylinder with a central angle of 60 degrees. These troidal sector-shaped electrodes 31 through 36 are arranged around the axis O with the same rotational angular separation. By applying a predetermined voltage to the troidal sector-shaped electrodes 31 through 36, the sector-shaped electric fields E1 through E6 are respectively formed within these electrodes. A flight space with a substantially hexagonal cross section is formed in the sector-shaped electric fields E1 through E6, and ions that pass in the flight space have the center orbit as shown by P in FIG. 1.

A deflection electrode 2 is provided between the troidal sector-shaped electrodes 31 and 36, which are adjacent along the loop orbit P. This electrode is used to put ions generated in the ion source 1 into the loop orbit P, to make ions flying along the loop orbit P to be deviated from the loop orbit P and sent them to the mass analysis flight space 6, or to make ions flying along the loop orbit P to be deviated from the loop orbit P and disposed. That is, in this mass spectrometer, the deflection electrode 2 doubles as the ion selector.

The ions which have departed from the loop orbit P pass through a dissociation area (which can be a separate dissociation chamber) 4 before they enter the mass analysis flight space 6. A laser light is delivered from a laser light source 5 into the dissociation area 4 in order to accelerate the dissociation of the ions. In place of delivering a laser light, another type of device for helping the dissociation of the ions may be provided, such as a collision cell which accelerates the dissociation of ions by the collision with a collision induced dissociation (CID) gas.

The mass analysis flight space 6 is a so-called reflectron TOF mass analyzer having a reflector 7 in which many plate electrodes are arranged along the flight direction of ions. Ions (product ions generated by the dissociation in the dissociation area 4) injected into the mass analysis flight space 6 are reversed by the electric field formed by the reflector 7 at the positions corresponding to their kinetic energy to reach the ion detector 8. The ion detector 8 detects the ions which arrive in this manner at different times corresponding to their mass, and generates an electric current signal corresponding to the number (amount) of incident ions. The detection signal produced by the ion detector 8 is provided to a data processor 10, where a time-of-flight spectrum and/or a mass spectrum (or an MS/MS spectrum) is created. Further, a variety of processes which will be described later will be performed.

An appropriate voltage is applied to the troidal sector-shaped electrodes 31 through 36, the deflection electrode 2, and the reflector 7, respectively from a loop flight voltage generator 14, a deflection voltage generator 15, and a reflector voltage generator 16. Each of these voltage generators 14, 15, and 16 is controlled by a controller 11. Connected to the controller 11 are an operation unit 12 operated by a user and a display unit 13.

In the configuration of FIG. 1, the loop orbit P has a substantially circular shape. However, the shape of the loop orbit P is not limited to this type; it can be any shape, such as an elliptical orbit or "8" figured loop orbit. The loop orbit P does not necessarily have to make ions turn on exactly the same orbit. For example, it may be a helical loop orbit or reciprocal orbit.

Figure 2:
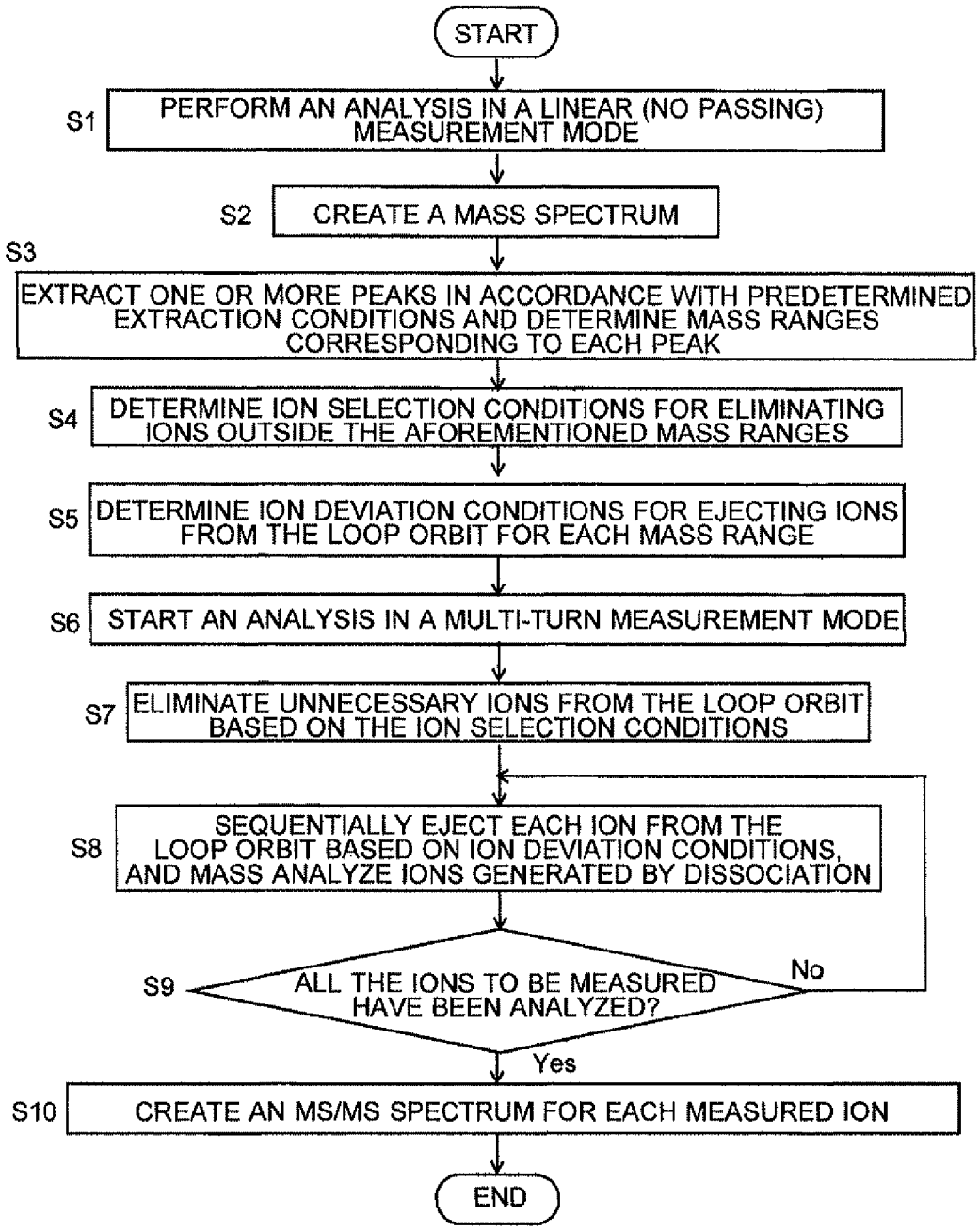
FIG. 2 is a flowchart showing a procedure of an embodiment of the mass-analyzing method according to the present invention.
Figure 3A:
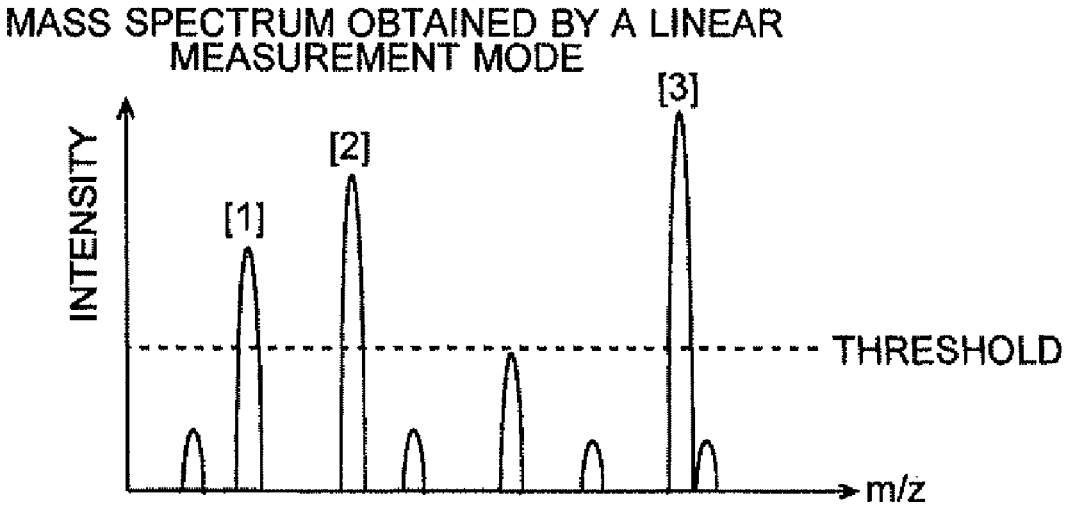
FIGS. 3A and 3B are schematic diagrams for explaining an embodiment of the mass-analyzing method according to the present invention.

Next, an example of the mass-analyzing method according to the present invention using the aforementioned mass spectrometer will be described with reference to FIGS. 2, 3A and 3B. FIG. 2 is a flowchart illustrating an embodiment of the mass-analyzing method according to the present invention, and FIGS. 3A and 313 are schematic diagrams for explaining this mass-analyzing method. The hereinafter described mass-analyzing method is for a structure analysis of a plurality of component molecules contained in a target sample, and for performing an MS/MS analysis of ions originating from the component molecules.

First, the controller 11 controls each unit so as to perform a linear measurement mode in which a variety of ions generated in the ion source 1 are directly introduced into the mass analysis flight space 6 where they are separated in accordance with their mass and then detected, without putting the ions into the loop orbit P or performing a dissociation operation in the dissociation area 4 (Step S1). Among the variety of ions that have departed from the ion source 1 at substantially the same time, ions having a smaller mass (to be exact, a smaller mass-to-charge ratio m/z) have a larger velocity, and thus fly faster to arrive at the ion detector 8 earlier to be detected.

In the analysis in Step S1, in the case where the mass range of the variety of ions generated in the ion source 1 is previously known and it is certain that the overtaking of ions will not occur after the ions undergo one or more turns along the loop orbit P, the ions may be made to complete that number of turns and then introduced into the mass analysis flight space 6.

The data processor 10 creates a time-of-flight spectrum based on the detection signal obtained in the ion detector 8 as previously described, and converts the flight time into the mass to create a mass spectrum (Step S2). For example, consider the case where a mass spectrum as shown in FIG. 3A has been obtained. As will be described later, compared to the case where the ions are made to turn multiple times along the loop orbit P, the mass resolving power is relatively low due to the shorter flight distance, so that the ions having approximate masses are not sufficiently separated.

In the next step, for each of the aforementioned mass analysis, the data processor 12 extracts peaks on the aforementioned mass spectrum in accordance with the previously set peak-extraction conditions and determines the mass range corresponding to the extracted peaks (Step S3). The peak extraction conditions are specified by the user through the input unit 12 in advance of the analysis. The user may appropriately set the conditions based on the purpose of the analysis and/or previously known information in order to analyze the component of interest. For example, one of the following conditions can be set:

(1) Any peak should be extracted if its mass at the center thereof (or at the center of gravity thereof) or its mass after a centroid process equals a value specified by the user or falls within a range specified by the user;

(2) Any peak having a peak intensity exceeding a specified threshold should be extracted;

(3) Only a specified number of peaks in descending order of peak intensity should be extracted;

(4) Only a specified number of peaks in descending or ascending order of mass should be extracted; or (5) Any peak having a peak width larger than a specified width should be extracted.

For example, consider the case where the aforementioned extraction condition (2) is set. If the threshold of the peak intensity is set as shown in FIG. 3A, three peaks indicated with [N] (where N=1, 2, or 3) are extracted. After the peaks are extracted in this manner, the mass range (i.e. the lower mass side limit and the higher mass side limit) is determined for each of the extracted peaks. In this embodiment, as shown in FIG. 3B, three different mass ranges, each corresponding to [N], are determined as the masses of the ions to be measured.

Subsequently, the data processor 10 determines the ion selection conditions under which only the ions included in the aforementioned mass ranges are left on the loop orbit P and any other ions having a mass outside the regions are excluded from the loop orbit P (Step S4). The exclusion of unnecessary ions can be performed by controlling the timing of changing the voltage applied to the deflection electrode 2 so that ions departing from the ion source 1 are not deflected to the loop orbit P but are made to fly straight. Alternatively, it can be performed by controlling the timing of changing the voltage applied to the deflection electrode 2 so that unnecessary ions, among ions which have once been put on the loop orbit P, are ejected out of the loop orbit P at the timing when these unnecessary ions pass the deflection electrode 2.

Figure 3B:
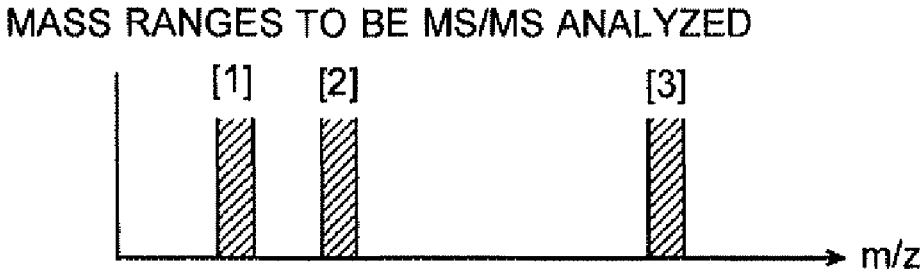

Generally, in the case where the mass range of the ions to be selected is relatively wide and the adjacent mass ranges are apart from each other as shown in FIG. 3B, it is possible to separate unnecessary ions from the ions to be measured before the ions departing from the ion source 1 reach the deflection electrode 2. Hence, unnecessary ions can be excluded at the point in time when ions are put into the loop orbit P. On the other hand, in the case where the mass of ions to be measured is specified in the form of a list prepared by a user as will be described later for example, the unnecessary ions may not be sufficiently separated from the ions to be measured at the point in time when ions are put on the loop orbit P. In such a case, it is preferable to once put ions into the loop orbit P, make the ions fly along the loop orbit P for a certain period of time to sufficiently separate the ions, and then exclude unnecessary ions. As the number of turns along the loop orbit P increases, the mass resolving power increases. Therefore, it is possible to finally screen out even an unnecessary ion having a mass which is different from that of the target ions only by 0.01, so that only the target ions are left on the loop orbit P. That is, in terms of mass separation, ions which can be eliminated at the point in time when they are put into the loop orbit P may be eliminated then, and ions which cannot be eliminated then may be excluded at an appropriate point in time after they are put into the loop orbit P. Therefore, it is possible to determine the ion selection conditions, or, to be more precise, the sequence of the voltage to be applied to the deflection electrode 2, in accordance with the mass ranges or masses to be selected.

Next, the data processor 10 determines the conditions for deviating ions (or deviation timings) from the loop orbit P to perform an MS/MS analysis for each of the mass ranges (or specified masses) (Step S5). After ions start to fly on the loop orbit P, the positional difference between ions having a smaller mass and ions having a larger mass gradually increases. Hence, after a certain number of turns, an ion having a smaller mass can catch and overtake another ion having a larger mass. Under such a circumstance, ions which will pass the deflection electrode 2 may not be of one certain kind; ions having a relatively smaller mass and ions having a relatively large mass and hence having been lapped might be mixed. If ions are deviated from the loop orbit P when ions are mixed as just described, the MS/MS analysis cannot be appropriately performed. Given this factor, in accordance with the masses (or mass ranges) to be measured, which are determined as previously described, the timing of deviation at which the mixture of ions flying along the loop orbit P will not occur is determined for each of the masses (or mass ranges).

After one kind of ions is deviated from the loop orbit P and MS/MS analyzed, if another kind of ions is immediately deviated from the loop orbit P to be MS/MS analyzed, an ion having a smaller mass generated by the dissociation of the latter ion as precursor ion might catch an ion having a relatively larger mass generated by the dissociation of the former ion as precursor ion in the mass analysis flight space 6. In other words, product ions originating from different precursor ions might be mixed. In order to prevent this, it is necessary to set appropriate time intervals in the case where ions are intermittently ejected from the loop orbit P, which is also taken into consideration in determining the deviation timings.

After the ion selection conditions and the ion deviation conditions are determined as previously described, the controller 11 controls each unit so as to perform an analysis in the multi-turn measurement mode for the same sample as used in the linear measurement mode (Step S6). That is, the target sample is ionized in the ion source 1 and made to start flying, and hence the ions are put into the loop orbit P through the deviation electrode 2 to be made to fly along the orbit. At this point in time, unnecessary ions are excluded from the loop orbit P based on the ion selection conditions, and only the ions in the mass ranges (or at the masses) to be measured are finally left on the loop orbit P (Step S7).

After that, while the remaining ions are flying along the loop orbit P, the deviation electrode 2 is controlled to deviate ions from the loop orbit P and direct them to the dissociation area 4 at the deviation timing based on the ion deviation conditions. Then, the product ions generated by dissociation in the dissociation area 4 are introduced into the mass analysis flight space 6, where they are separated in accordance with their mass, and the ions are detected by the ion detector 8 (Step S8). Until all the ions to be measured are MS/MS analyzed, the process returns from Step S9 to Step S8, whereby ions having a different mass are sequentially deviated from the loop orbit P and MS/MS analyzed. Based on the obtained signal, the data processor 10 creates an MS/MS spectrum for each group of ions ejected from the loop orbit P, i.e. for each kind of ion to be measured (Step S10).

As previously described, with this mass analyzing-method, the loop orbit P is used for selecting and storing ions, whereby plural kinds of ions having different masses can be selected and stored with a high mass resolving power. Then the plural kinds of ions can be individually and sequentially MS/MS analyzed.

In the previously described embodiment, the ions to be measured and MS/MS analyzed are automatically extracted based the mass spectrum obtained in the linear measurement mode. However, the ions to be measured can be set by other methods. For example, in the case where the component molecules contained in the target sample are previously known or can be deduced with a high probability, the user (or operator) may specify the ions to be measured, and provide a list of the masses of the ions to be measured through the input unit 12 so that the process in and after Step S4 is performed in accordance with the list.

In principle, there is no upper limit of the number of turns of ions which are made to fly along the loop orbit P. However, actually, the ion transmission rate will not be 100%; the number of ions which continue turning decreases, although gradually, which decreases the sensitivity. Given this factor, it is preferable to set a maximum time of measurement for each measurement (i.e. every time a packet of ions is ejected from the ion source 1). This might lead to the case where the ion deviation conditions for all the set ions to be measured cannot be set within the maximum time of measurement. In such a case, under the restriction of the maximum time of measurement, the given mass ranges (or masses) of ions to be measured may be divided into plural groups so that all the ions to be measured can be MS/MS analyzed by a plurality of measurements.

It should be noted that the embodiment described thus far is merely an example of the present invention, and it is evident that any modification or adjustment appropriately made within the spirit of the present invention is also included in the scope of the claims of the present application.

The invention claimed is:

1. A mass-analyzing method using a multi-turn time-of-flight mass spectrometer having:

an ion source;

a loop orbit along which a variety of ions departing from the ion source are made to fly once or repeatedly plural times;

an ion selector for selecting ions from the ions flying along the loop orbit by allowing a passage of ions along the loop orbit only within a predetermined time range;

a dissociation means for dissociating ions deviated from the loop orbit; and a mass analyzing means for mass analyzing product ions generated by the dissociation, the mass-analyzing method comprising:

a) a setting step for setting a plurality of masses of ions to be measured;

b) an ion selection step for obtaining the predetermined time range for each of the plurality of masses set in the setting step and for operating the ion selector so as to allow the passage of ions only within the predetermined time range and thereby select, on the loop orbit, each of the ions having the set plurality of masses;

c) a deviation timing determination step for obtaining deviation timings at which different kinds of ions are not mixed when the ions having the set plurality of masses are deviated from the loop orbit, time intervals of the deviation timings being determined so that a mixture of product ions will not occur while the deviated ions are dissociated and mass analyzed; and d) an analysis step for sequentially deviating ions having each of the plurality of masses left on the loop orbit in accordance with the determined deviation timings, for dissociating the deviated ions by the dissociation means to generate product ions, and for analyzing the product ions by the mass analyzing means.

2. The mass-analyzing method according to claim 1, wherein:

in a first measurement of a target sample, the variety of ions departing from the ion source are made to fly while bypassing the loop orbit or to fly along the loop orbit until they undergo a number of turns which ensures that an overtaking of the ions will not occur on the loop orbit, and then they are mass analyzed by the mass analyzing means to create a time-of-flight spectrum or a mass spectrum;

in the setting step, the plurality of masses to be measured are set by selecting a peak or peaks complying with predetermined conditions among peaks appearing on the time-of-flight spectrum or the mass spectrum; and in a second or later measurement of the target sample, processes of the ion selection step, the deviation timing determination step, and the analysis step are performed.

3. The mass-analyzing method according to claim 2, wherein:

in a case where a mass analysis of ions having all the masses set in the setting step cannot be performed in one measurement under predetermined time conditions, all the set masses are divided into a plurality of groups to perform the plurality of measurements.

4. The mass-analyzing method according to claim 1, wherein:

in the setting step, a plurality of masses of ions in different charge states and originating from substantially a same molecule are set.

5. The mass-analyzing method according to claim 4, wherein:

in a case where a mass analysis of ions having all the masses set in the setting step cannot be performed in one measurement under predetermined time conditions, all the set masses are divided into a plurality of groups to perform the plurality of measurements.

6. The mass-analyzing method according to claim 1, wherein:

in the setting step, the plurality of masses are set based on a list of ions which is prepared in advance.

7. The mass-analyzing method according to claim 6, wherein:

in a case where a mass analysis of ions having all the masses set in the setting step cannot be performed in one measurement under predetermined time conditions, all the set masses are divided into a plurality of groups to perform the plurality of measurements.

8. The mass-analyzing method according to claim 1, wherein:

in a case where a mass analysis of ions having all the masses set in the setting step cannot be performed in one measurement under predetermined time conditions, all the set masses are divided into a plurality of groups to perform the plurality of measurements.

* * * * *